US008679203B2

(12) United States Patent
O'Brien et al.

(10) Patent No.: US 8,679,203 B2
(45) Date of Patent: Mar. 25, 2014

(54) METHOD OF SCAVENGING MERCAPTANS FROM HYDROCARBONS

(75) Inventors: Timothy J. O'Brien, Sugar Land, TX (US); Jerry J. Weers, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 560 days.

(21) Appl. No.: 12/951,849

(22) Filed: Nov. 22, 2010

(65) Prior Publication Data

US 2011/0113680 A1 May 19, 2011

Related U.S. Application Data

(63) Continuation-in-part of application No. 12/042,536, filed on Mar. 5, 2008, now abandoned.

(60) Provisional application No. 60/895,625, filed on Mar. 19, 2007.

(51) Int. Cl.
*C10L 1/22* (2006.01)

(52) U.S. Cl.
USPC ..... 44/422; 208/189; 208/191; 208/207; 252/185; 252/189; 252/191

(58) Field of Classification Search
USPC ..... 44/422; 208/189, 191, 207; 252/185, 252/189, 191
See application file for complete search history.

(56) References Cited

U.S. PATENT DOCUMENTS

| | | | | |
|---|---|---|---|---|
| 3,928,211 | A | | 12/1975 | Browning et al. |
| 4,127,474 | A | | 11/1978 | Frame |
| 4,594,147 | A | | 6/1986 | Roof et al. |
| 4,778,617 | A | | 10/1988 | Shaer et al. |
| 4,867,865 | A | | 9/1989 | Roof |
| 4,923,596 | A | * | 5/1990 | Bricker et al. ..... 208/207 |
| 5,183,560 | A | | 2/1993 | Roof et al. |
| 5,232,887 | A | | 8/1993 | Arena et al. |
| 5,286,372 | A | | 2/1994 | Arena et al. |
| 5,413,704 | A | | 5/1995 | Gillespie et al. |
| 5,744,024 | A | | 4/1998 | Sullivan, III et al. |
| 5,840,177 | A | | 11/1998 | Weers et al. |
| 6,013,175 | A | | 1/2000 | Weers et al. |

FOREIGN PATENT DOCUMENTS

EP 0538819 A2 4/1993

OTHER PUBLICATIONS

Baker Hughes, "Elimination of Caustic Treating for Gasoline Components," Product Brochure, Feb. 2002.
Baker Hughes, "Odor Control Program Allows Refiner to Ship Problem Free," Product Brochure, Jan. 2004.
Baker Hughes, "SULFIX 9281 Mercaptan Scavenger Allows Bypass of FCCU Merox," Product Brochure, Feb. 2004.
Baker Hughes, "Mercaptan Scavenger Helps Refiner Lower Mercaptans in Propane," Product Brochure, Mar. 2005.
Basu, B. et al., "Merox and Related Metal Phthalocyanine Catalyzed Oxidation Processes," 2374 Catal. Rev.—Sci. Eng., 35(4), pp. 571-609 (Dec. 1993).
Examination Report in EP Appln. 08 731 506.5-1361, dated Dec. 13, 2013.

* cited by examiner

*Primary Examiner* — Cephia D Toomer
(74) *Attorney, Agent, or Firm* — Mossman Kumar & Tyler PC

(57) ABSTRACT

Hydrogen sulfide and mercaptans in hydrocarbons, gas mixtures of hydrocarbons and the like may be scavenged therefrom by being brought into intimate contact with a mercaptan scavenger formulation of quaternary ammonium alkoxide or hydroxide in the presence of a high oxidative state metal such as cobalt, iron, chromium and/or nickel. The high oxidative state metal, being an oxidizer, acts as a catalyst when combined with the quaternary ethoxide or hydroxide for improved mercaptan scavenging performance.

11 Claims, No Drawings

METHOD OF SCAVENGING MERCAPTANS FROM HYDROCARBONS

CROSS-REFERENCE TO RELATED APPLICATION

This application is a continuation-in-part patent application of U.S. Ser. No. 12/042,536 filed Mar. 5, 2008, now abandoned, which in turn claimed the benefit of U.S. Provisional Application No. 60/895,625 filed Mar. 19, 2007.

TECHNICAL FIELD

The present invention relates to methods and compositions for scavenging of mercaptans in hydrocarbon fluids and more particularly to the use of quaternary ammonium hydroxides and/or quaternary ammonium alkoxides as mercaptan and/or $H_2S$ scavengers.

TECHNICAL BACKGROUND

Hydrocarbon fluids, such as crude oil, crude oil emulsions, oilfield condensate, petroleum residua and even refined fuels often contain a variety of mercaptans, including mercaptans of relatively low molecular weight. In the drilling, production, transport, storage, and processing of hydrocarbon stocks, the mercaptans encountered can cause many problems ranging from malodors to metal corrosion. Because of the volatility of mercaptans of relatively low molecular weight (for example, methyl mercaptan, $CH_3SH$, ethyl mercaptan, $CH_3CH_2SH$ and propyl mercaptan, $CH_3CH_2CH_2SH$), they tend to evolve into vapor spaces, where their offensive odors create problems in and around storage areas and throughout pipelines and shipping systems used for transporting the hydrocarbon.

Various additives have been employed in efforts to alleviate these problems. For example, choline or choline hydroxide has been found to alleviate hydrogen sulfide evolution and to scavenge mercaptans. See, for example, U.S. Pat. Nos. 4,594,147 to Roof et al., 4,867,865 to Roof and 5,183,560 to Roof et al. However, choline and choline hydroxide are not well suited for many uses and media, such as in crude oil. Although choline and choline hydroxide might scavenge mercaptans in such media, they also form a volatile and malodorous by-product with the sulfur compounds indigenous to such media. Accordingly, the use of choline and choline hydroxide to control odors associated with light weight mercaptans is self-defeating in media such as crude oil. Thus, the cited patents to Roof and Roof, et al. fail to address this problem and instead describe the use of choline or choline hydroxide in the more refined fuel oils.

European application 0 538 819 A3 to Roof et al. describes the use of oil-soluble quaternary ammonium compounds of the formula:

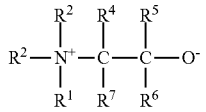

to scavenge various sulfur compounds, including mercaptans, from certain oils, especially high boiling, heavy residual fuels. These compounds, prepared under anhydrous conditions, are what are described herein as "internal ions"; i.e., the positive charge on the nitrogen and the negative charge on the oxygen result in overall electrically neutral compounds without the presence of counter ions such as halides. The European application stresses the significance of the oil solubility of these compounds, noting that they are more oil soluble than choline base and so disperse through the oil being treated more thoroughly to decrease the concentration of undesirable sulfur compounds more effectively. Nevertheless, the compositions of the European application suffer from certain disadvantages. For example, compositions that are produced in higher yields, yet still at low cost, and that reduce mercaptan concentrations more effectively are still desired.

U.S. Pat. Nos. 5,840,177 and 6,013,175 relate to methods for scavenging mercaptans in hydrocarbon fluids using quaternary ammonium hydroxides.

Other chemistries and methods for removing mercaptans from hydrocarbons include caustic (NaOH solutions) and cobalt with caustic (MEROX™ process of UOP, Merichem processes).

There is a continuing need in the liquid fuel industry for treating liquid hydrocarbon stocks and wet or dry gas mixtures containing mercaptans using new compositions and methods.

SUMMARY

There is provided, in one non-limiting embodiment a method for scavenging $H_2S$ and/or mercaptans in a hydrocarbon fluid that involves adding to the hydrocarbon fluid an effective scavenging amount of an aqueous scavenging composition. The scavenging composition includes an additive selected from the group consisting of a quaternary ammonium hydroxide, a quaternary ammonium alkoxide, and mixtures thereof, in the presence of a metal in an oxidation state of 3+ or greater. The additive reacts with $H_2S$ and/or mercaptans in the fluid. There is an absence of an oxidizing agent.

The quaternary ammonium hydroxide has the formula selected from the group consisting of $R^1R^2R^3N^+OHOH^-$, $R^1R^2R^3N^+CH_2CHR^5OHOH^-$ and $R^1R^2R^3R^4N^+OH^-$, and the quaternary ammonium alkoxide has the formula $R^1R^2R^3R^4N^+O^-$, where:

- $R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms,
- $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, and
- $R^4$ is selected from the group consisting of H, alkyl groups of from 2 to about 18 carbon atoms, alkylaryl groups of from 7 to about 18 carbon atoms, $—(CH_2CH_2O)_nH$, where n is from 1 to about 18,

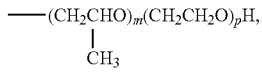

where m and p are independently selected from integers from 0 to about 18, except that the sum m+p is less than or equal to 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, —$SR^7$ and —$NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms or alkylaryl groups of from 7 to about 18 carbon atoms.

Further, there is provided in another non-restrictive version a hydrocarbon composition that has a reduced $H_2S$ and/or mercaptan presence which includes a hydrocarbon fluid, $H_2S$ and/or mercaptans, and an effective scavenging amount of an aqueous scavenging composition. The composition includes an additive selected from the group consisting of a quaternary ammonium hydroxide, a quaternary ammonium alkoxide, and mixtures thereof, in the presence of a metal in an oxidation state of 3+ or greater. The quaternary ammonium hydroxide has the formula $R^1R^2R^3N^+OHOH^-$, $R^1R^2R^3N^+CH_2CHR^5OHOH^-$ and/or $R^1R^2R^3R^4N^+OH^-$, and the quaternary ammonium alkoxide has the formula $R^1R^2R^3R^4N^+O^-$, where $R^1$, $R^2$, $R^3$, and $R^4$ are as defined above. At least some of the additive in the hydrocarbon composition has reacted with the $H_2S$ and/or mercaptan. Again, there is an absence of an oxidizing agent.

DETAILED DESCRIPTION

As defined herein mercaptans are thiols and are defined as any of a group of organic compounds resembling alcohols, but having the oxygen of the hydroxyl group replaced by sulfur. Hydrogen sulfide ($H_2S$) may also be scavenged by the methods and additives herein, and while not technically a mercaptan may be understood as included among the species being scavenged. It will thus be understood that when "mercaptan" is discussed, $H_2S$ is included as a species that will also be scavenged herein.

It has been unexpectedly discovered that certain quaternary ammonium hydroxides and alkoxides are surprisingly effective mercaptan scavengers that scavenge $H_2S$ and mercaptans, particularly low weight mercaptans selectively in preference to higher weight mercaptans. These additives are believed to react with the $H_2S$ and/or mercaptans in the fluid. It has been further unexpectedly discovered that these quaternary ammonium hydroxides and alkoxides have their scavenging ability improved in the presence of a high oxidative state metal, such as cobalt, which may act as a catalyst when combined with the quaternary ammonium hydroxides and/or alkoxides. The exact mechanism by which the methods herein operate is not known, and it may be that the presence of a high oxidative state metal is not "catalytic" in the strict chemical sense; the inventors herein do not wish to be limited by any particular explanation.

It will also be appreciated that it is not necessary for all of the $H_2S$ and/or mercaptan present in the hydrocarbon to be reacted and/or removed for the compositions, additives, and methods herein to be considered successful. The compositions and methods have accomplished a goal when the amounts of $H_2S$ and/or mercaptan are reduced as a consequence of being contacted with the compositions described herein.

The efficacy of the hydroxides and alkoxides is especially surprising in view of the findings that the hydroxides are significantly more effective scavengers than compounds differing only in the counter ion (i.e., it is other than hydroxide), and that in some non-limiting cases the hydroxides are even more effective mercaptan scavengers than the corresponding internal ions (i.e., $R_3N^+R'O^-$ where $R_3N^+R'OHOH^-$ is the hydroxide).

The selectivity of the hydroxides reduces the waste that would otherwise be encountered in scavenging higher molecular weight mercaptans unnecessarily, and so permits scavenging of the less desirable mercaptans with relatively small amounts of the hydroxides. And, even though the European application noted above stresses the importance of the oil-solubility of its compounds to their efficacy, the superior efficacy of the hydroxides in scavenging mercaptans in hydrocarbons has been found even though the hydroxides would be expected to be significantly less oil-soluble than their corresponding internal ions.

Moreover, it has been found that in some non-restrictive embodiments introducing oxygen such as by sparging the treated fluid with air increases the scavenging activity. However, in another non-limiting embodiment, the compositions and methods herein may be practiced in an absence of an oxidizing agent, in particular in the absence of an added oxidizing agent. As defined herein, oxidizing agents include, but are not necessarily limited to air, molecular oxygen ($O_2$), and/or oxygen-containing gas and mixtures thereof.

The quaternary ammonium hydroxide has the formula $R^1R^2R^3N^+OHOH^-$, $R^1R^2R^3N^+CH_2CHR^5OHOH^-$ or $R^1R^2R^3R^4N^+OH^-$, and the quaternary ammonium alkoxide has the formula $R^1R^2R^3R^4N^+O^-$. $R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms.

$R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom.

$R^4$ is selected from the group consisting of H, alkyl groups of from 2 to about 18 carbon atoms, alkylaryl groups of from 7 to about 18 carbon atoms, —$(CH_2CH_2O)_nH$, where n is from 1 to about 18,

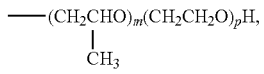

where m and p are independently selected from integers from 0 to about 18, except that the sum m+p is less than or equal to 18, and —$CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, —$SR^7$ and —$NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms. In one non-restrictive version, $R^4$ is —$(CH_2CH_2O)_nH$ or —$CHR^5CHR^6Y$, where n, $R^5$, $R^6$ and Y are defined as above.

$R^5$ may be hydrogen, alkyl groups of from 1 to about 18 carbon atoms or alkylaryl groups of from 7 to about 18 carbon atoms.

In choline base, each of $R^1$, $R^2$ and $R^3$ is methyl. It now has been found that if one of $R^1$, $R^2$ and $R^3$ is longer than methyl, scavenging may be carried out even in crude oil without the volatile, malodorous scavenging by-products trimethylamine generated with use of the choline base. Accordingly, $R^3$ has been designated as the radical having at least two carbon atoms. In some non-limiting forms, $R^1$ and $R^2$ are alkyl groups of eighteen or fewer carbon atoms and in other non-restrictive embodiments lower alkyl groups of six carbons or fewer, especially three carbons or fewer and, alternatively, methyl groups. In another non-limiting embodiment, $R^3$ is a fatty group, such as from about eight to about eighteen carbon atoms, on the other hand about ten to about fourteen carbons atoms, such as a coco-group. However, alternatively, $R^3$ may be a benzyl group or substituted aryl groups, for example, alkylbenzyl groups such as methyl benzyl, or, less desirably, even may be an alkyl group of at least about two carbon atoms. In other non-restrictive embodiments, $R^2$ and $R^3$ may be joined to form a heterocyclic ring including the N and optionally an oxygen atom. In the latter case, a morpholine may be formed. Such ring products have been found to be less effective than some other products and may be more difficult to prepare by oxyalkylation of a tertiary amine.

$R^4$, as noted, corresponds to the formula $—(CH_2CH_2O)_nH$, where n is an integer from one to about eighteen, the formula

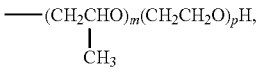

$$—(CH_2\underset{\underset{CH_3}{|}}{C}HO)_m(CH_2CH_2O)_pH,$$

where m and p are integers from zero to about eighteen (independently selected except that m+p is less than or equal to about eighteen), or the formula $—CHR^5CHR^6Y$, where $R^5$ and $R^6$ and Y are defined as above. Inclusion of such $R^4$ groups in the quaternary compound has been found to increase the performance of the compound as a mercaptan scavenger significantly over that of tetraalkyl quaternary compounds. In one non-limiting embodiment, $R^4$ corresponds to the formula $—CHR^5CHR^6Y$, where $R^5$ and $R^6$ are hydrogen or lower alkyls of fewer than about six carbon atoms, in one non-restrictive version hydrogen, and Y is —OH.

However, when the quaternary compound is prepared by reacting a tertiary amine with an alkylene oxide to form a quaternary compound where $R^4$ is $—CH_2CH_2OH$, quaternary compounds are also formed where $R^4$ is the ether or polyether group $—(CH_2CH_2O)_nH$. Thus, a composition containing quaternary compounds where $R^4$ is $—(CH_2CH_2O)_nH$ often also contains quaternary compounds where $R^4$ is the ether or polyether group $—(CH_2CH_2O)_nH$. Generally, however, if the quaternary compound is prepared by oxyalkylating a tertiary amine, the amine is reacted with the alkylene oxide in a molar ratio of about 1:1 so that, while some amine remains unreacted thereby leaving some alkylene oxide available for polyether formation, typically the ether or polyether chains that do form are short; n being mostly one, two or three.

The quaternary ammonium hydroxides described herein may be prepared by a variety of known techniques that will be readily apparent to those of ordinary skill in the art. For example, the quaternary ammonium hydroxides may be prepared by ion exchange techniques from readily available quaternary ammonium halides, such as quaternary ammonium chlorides. By such techniques, the quaternary ammonium halides may be passed through an ion exchange column for exposure to an ion exchange resin, exchanging the halide ion for $OH^-$ ions (or $Y^-$ ions where Y is as defined above and does not correspond to OH) from the column. Thus, according to this method for producing the hydroxide, the halide $R^1R^2R^3R^4N^+Z^-$, where $R^1$, $R^2$, $R^3$ and $R^4$ are as defined in the broader definition above and $Z^-$ is a halide, is brought into contact with an ion exchange resin bearing hydroxide ions to form $R^1R^2R^3R^4N^+OH^-$.

Alternatively, the quaternary ammonium hydroxides described herein may be prepared by oxyalkylation of tertiary amines in the presence of water. Techniques for oxyalkylation of tertiary amines have been described, for example, in the European patent application noted above, but the European application requires the reaction to be carried out under anhydrous conditions. Anhydrous conditions were necessary for the formation of the internal ions of the European application. This reaction gives the quaternary ammonium alkoxides discovered to be useful herein. Quaternary ammonium ethoxides are formed when ethylene oxide is reacted with tertiary amines to give $R^1R^2R^3N^+CH_2CHR^4O^-$ where $R^4$ is H, and $R^1$, $R^2$ and $R^3$ are as defined previously.

The hydroxides have been discovered to be beneficial. Such compounds are formed when the oxyalkylation is carried out in the presence of water. And, surprisingly, it has been discovered that the reaction carried out in the presence of water results in yields of the quaternary ammonium hydroxide product that are significantly higher than the yields of quaternary ammonium internal ion resulting from the reaction carried out under anhydrous conditions. Moreover, carrying out the reaction in the presence of water allows the use of less oxide per amine than called for in the non-aqueous reaction of the European application of Roof et al. (that is, a 1:1 molar ratio may be employed as opposed to bubbling the oxide through the amine as called for by Roof et al.). In addition, the aqueous reaction proceeds much faster than does the non-aqueous reaction and so the quaternary product may be formed in much less time. Where Y of $R^4$ is a non-acidic group other than $OH^-$, a similar reaction may be carried out with, for example, an alkylene sulfide or alkyleneimine instead of an alkylene oxide.

Thus, it has been discovered that if the oxyalkylation reaction is carried out in the presence of water, the resulting quaternary ammonium hydroxides not only are more effective mercaptan scavengers in certain non-limiting cases than are the internal ions (the quaternary ammonium alkoxides) that would have been produced had the reaction taken place in the absence of water, but also are produced in higher yields than the internal ions would have been.

Accordingly, in more detail, where $R^4$ of the quaternary ammonium hydroxide $R^1R^2R^3R^4N^+OH^-$ is hydroxyethyl or hydroxypropyl, or if $R^4$ is an ether or polyether group as described above, the hydroxide may be prepared by reacting a tertiary amine such as of the form $R^1R^2R^3N$ with an alkylene oxide, in the presence of water. The alkylene oxide may be propylene oxide, but ethylene oxide is useful in one non-limiting embodiment. In alternative embodiments where the quaternary ammonium compound $R^1R^2R^3R^4N^+$ is not a hydroxide, but $R^4$ corresponds to the formula $—CHR^5CHR^6Y$, where $R^5$ and $R^6$ are defined above and Y is a non-acidic group corresponding to the formula $—SR^7$ or $—NR^7R^8$, an alkylene sulfide or alkyleneimine, respectively, may be substituted for the alkylene oxide and otherwise the same procedures may be followed.

$R^1$, $R^2$ and $R^3$ of the tertiary amine are as defined above. In one non-limiting embodiment, however, $R^1$ is methyl and alternatively $R^2$ is also methyl. Although $R^2$ and $R^3$ may be joined to form a heterocyclic ring including the N and optionally an oxygen atom, such as to form a morpholine derivative, such compositions have been found to be more difficult to oxyalkylate without the offset of producing more potent scavengers and so in some configurations, $R^2$ and $R^3$ are not joined. In one non-restrictive version, $R^3$ is a fatty group of from about six to about twelve carbon atoms.

The reaction may be carried out in an aqueous solvent. For example, the solvent may comprise about 50% by weight to about 95%, by weight alcohol such as isopropanol or, in one useful embodiment, methanol, and about 5% by weight to about 50% by weight water. A typical solvent formulation, therefore, might comprise, by weight, two parts solvent to one part water.

The active ingredients may make up about 70% by weight of the reaction mixture (the remaining 30% being solvent). In one non-limiting method of preparation, the tertiary amine is stirred in the solvent and the system is pressurized with alkylene oxide added in a molar ratio of about 1:1 to the amine. Generally, the molar ratio is in the range of from about 1:1 to about 1.5:1 alkylene oxide to amine. The reaction is carried out at a temperature typically under about 70° C., in one non-limiting embodiment about 40° C. to about 50° C., with continuous stirring and its completion is signaled by a drop in pressure to about atmospheric. The resulting mixture, aside from unreacted solvent, is a combination of the quaternary compounds where the $R^4$s are of the formulae $—CH_2CH_2OH$ and $—(CH_2CH_2O)_nH$, where n is as defined above, unreacted amine, and glycols formed from reaction of the alkylene oxide and water. Other quaternary ammonium hydroxides where $R^4$ corresponds to the formula $$—(CH_2\underset{\underset{CH_3}{|}}{C}HO)_m(CH_2CH_2O)_pH,$$

or the formula $—CHR^5CHR^6Y$ where m, p, $R^5$, $R^6$ and Y are as defined above, may be prepared by similar techniques that will be readily apparent to those of ordinary skill in the art.

It has been unexpectedly discovered that the quaternary ammonium hydroxides and quaternary ammonium alkoxides described herein have improved $H_2S$ and/or mercaptan scavenging properties when they are in the presence of a metal of a high oxidation state. As used herein, "high oxidation state" means the metal is present in a primary valence that is capable of being reduced without forming the element. Typically this is an oxidation state of 3+ or greater for most metals of interest. In one non-limiting embodiment these metals are believed to act as catalysts in some way, but the inventors do not wish to be limited to any particular theory. Alternatively, the metals may function as an oxidizer. Metals of high oxidation state suitable to give the desired effect include, but are not necessarily limited to, Co(+3), Fe(+3), Cr(+6,+3), Ni(+3), Cu(+2), Ce(+3,+4) and combinations thereof.

In another non-restrictive version, the compositions and methods herein may be practiced in the absence of a catalyst on a basic support. In particular, in a non-limiting embodiment, the methods and compositions described are practiced in the absence of a metal chelate on a solid base, such as those described in U.S. Pat. No. 5,286,372. Such solid bases may be metal oxides, a layered double hydroxide and mixtures thereof.

The metals may be present as water or oil soluble salts and complexes. Specific, non-limiting examples of metals suitable for use in the compositions and methods herein include, but are not limited to DBM 830, which consists of a mixture of aqueous caustic, water, dimethylethanolamine, monoethanolamine, formaldehyde, nonionic surfactants (nonyl phenol ethoxylate) and Merox catalyst (cobalt phthalocyanine complex) available from UOP.

The resulting additive, be it quaternary ammonium hydroxide or quaternary ammonium alkoxide may be added to the hydrocarbon fluid to be treated by standard techniques, such as by injection or simple pouring and it may be dispersed throughout the fluid by stirring or other agitation. Enough of the additive should be added that is effective to scavenge at least a portion of the $H_2S$ and/or mercaptan. The additive is incorporated at a level sufficient to scavenge the $H_2S$ and/or mercaptans to a desired degree and will depend on the mercaptan content of the medium and the corresponding stoichiometry. However, typical additive levels may be on the order of about 20 to about 10,000, in one non-limiting embodiment from a lower threshold of about 100 independently to an upper threshold of about 5,000, ppm based on the weight of the medium to be treated, alternatively from a lower threshold of about 500 independently to an upper threshold of about 1000 ppm.

The amount of metal in the hydrocarbon fluid may range from about 10 to about 1000 ppm, alternatively up to about 500 ppm, based on the hydrocarbon fluid. In one non-limiting embodiment, the formulations of the aqueous scavenging composition may have from 0.1 to 5 wt % of the additive being metal with the remainder being alkoxide/hydroxide.

The medium may be any hydrocarbon fluid, and a liquid is expected to be most common, although dry gas mixtures containing mercaptans may also be treated. For example, excellent results have been obtained from treatment of crude oil, petroleum residua and fuels such as kerosene. It should be recognized that while the fluids are referred to as hydrocarbon fluids, in some cases (for example, crude oil emulsions), hydrocarbons may make up less than half of the fluid by weight. The product is particularly useful for treatment of crude oil in that it does not add an additional malodorous compound as has been associated with the use of choline to treat crude oil. More specifically, the hydrocarbon fluids to which the method herein may be applied include, but are not limited to, crude oil, oil field condensates (e.g. naphtha, etc.), residual fuels, petroleum distillates (e.g. gasoline, kerosene, diesel, etc.) light hydrocarbons (e.g. propane, butane, etc.), aromatic solvents (e.g. toluene, xylene, etc.) and paraffinic solvents (e.g. pentane, heptane, etc.), renewable fuels such as biodiesel, and mixtures thereof. Further, the hydrocarbon fluids may contain oxygenated compounds such as alcohols, esters, glycols, ethers and the like and mixtures thereof.

In addition, even significantly greater degrees of scavenging have been found to result if the medium is first oxygenated such as by aeration prior to addition of the mercaptan scavenger. However, in other non-limiting embodiments, an oxidizing agent, such as air or oxygen, is not used. Although the inventors do not wish to be bound by any particular theory, it is believed that the mechanism by which this scavenging occurs is according to the following reaction sequence where $R^1R^2R^3R^4N^+OH^-$ is the scavenger and RSH is the mercaptan:

$$R^1R^2R^3R^4N^+OH^- + RSH \rightarrow RS^- + R^1R^2R^3R^4N^+ \quad 2RS^- + O_2 \rightarrow RSSR \text{ (disulfide)}$$

Thus, increasingly improved results have been noted as the amount of oxygen added such as by aerating or bubbling air into the medium increases to 100% of the stoichiometry of this reaction scheme. Addition of air in an amount beyond 100% has not been found to improve scavenging much more than that associated with addition of 100% of stoichiometry. However, as noted, in some non-limiting embodiments, there is an absence of an added oxidizing agent, such as air, molecular oxygen and the like.

Effective scavenging may be carried out at the ambient temperature of the hydrocarbon fluid (e.g., about 20° C. for stored crude oil, residuum or fuel), but the performance of the scavenger has been found to be improved at higher temperatures such as about 50° C. to about 75° C. The scavenger tends to decompose at even higher temperatures, such as at about 100° C. However, the decomposition at such temperatures occurs relatively slowly while the time for the reaction between the scavenger and the mercaptans is relatively short, generally requiring only several hours to reduce the mercaptan level substantially. Thus, the scavenger may still be employed at such elevated temperatures with good results.

It has been found that the scavenging additives herein remove $H_2S$ first, and then start removing or reacting with the mercaptans. The quaternary ammonium scavengers herein have been found to react selectively with the lower molecular weight mercaptans without imparting to the system an odor of its own. More particularly, for example, the scavengers have been found to scavenge methyl mercaptan in preference to ethyl mercaptan and to scavenge ethyl mercaptan in preference to n-propyl mercaptan and to scavenge n-propyl mercaptan in preference to n-butyl mercaptan, and so forth. It also has been observed that the scavengers react selectively with linear mercaptans over branched mercaptans. Thus, the scavengers enable removal of the most volatile mercaptans, which are the greatest contributors to odor problems, with limited waste of scavenger on side reactions with less volatile mercaptans. It is believed that adding the high oxidation state metal helps speed the scavenging of lower mercaptans as well as improves the removal of higher mercaptans (i.e. through C12 or dodecyl mercaptans).

The following examples describe certain specific, non-limiting embodiments of the methods and compositions. Other embodiments within the scope of the claims herein will be apparent to one skilled in the art from consideration of the specification or practice of the methods and compositions as disclosed herein. It is intended that the specification, together with the examples, be considered exemplary only, with the scope and spirit of the methods and compositions being indicted by the claims which follow the examples. In the examples, all percentages are given on a weight basis unless otherwise indicated.

EXPERIMENTAL

Mercaptan Scavenger A was made according to the methods of U.S. Pat. Nos. 5,840,177 and 6,013,175, mentioned above, assigned to Baker Hughes Incorporated, incorporated by reference herein in their entirety. Mercaptan Scavenger A was a quaternary ammonium hydroxide prepared from dimethyl soya amine and ethylene oxide.

As shown in Table I, Mercaptan Scavenger A was used alone and together with DBM 830, also used alone, in the indicated dosages. The initial mercaptan proportion was 533 ppm. The liquid phase mercaptan (RSH) proportion after 24 hours and after 5 days was noted. The hydrocarbon used in this testing was Caspian Pipeline Crude containing an unknown mix of naturally occurring mercaptans with an additional 205 ppm of C3 mercaptan (i.e. 1-propanethiol; $CH_3CH_2CH_2SH$) artificially added.

TABLE I

Reduction of RSH Portion Using Scavenger and Cobalt

| Ex. | Additive | Dosage ppm | Liquid Phase RSH 24 hrs | Liquid Phase RSH 5 days |
|---|---|---|---|---|
| 1 | blank | 0 | 533 ppm | 529 ppm |
| 2 | Scavenger A | 1000 | 498 ppm | 426 ppm |
| 3 | DBM 830 | 1000 | 346 ppm | 159 ppm |
| 4 | Scavenger A + DBM 830 | 500 + 500 | 276 ppm | 112 ppm |
| 5 | Scavenger A | 2000 | 308 ppm | 185 ppm |
| 6 | DBM 830 | 2000 | 291 ppm | 107 ppm |
| 7 | Scavenger A + DBM 830 | 1000 + 1000 | 273 ppm | 61 ppm |

It may be seen from Table I that the mercaptan levels using both Scavenger A and DBM 830 (Examples 4 and 7) are reduced to a greater extent as compared with adding the reductions obtained from the Examples using Scavenger A alone (Examples 2 and 5) or those using DBM 830 alone (Examples 3 and 6). It may be seen that in all Examples, whether calculated as an absolute reduction in ppm units, or as a percentage of the starting RSH content, the reduction in mercaptan is synergistic, that is, greater than would be expected from adding the effects of the two components together. This result is unexpected.

Among the several advantages of the methods herein, may be noted the provision of a method for scavenging mercaptans more effectively and efficiently than in conventional methods, the provision of such method that scavenges selectively for light weight mercaptans versus heavier weight mercaptans, and the provision of such method that does not tend to generate new malodorous compositions.

Further evidence of the surprising combined benefit of a quaternary ammonium compound with a metal of an oxidation state of 3+ or greater is seen in Examples of 8, 9 and 10 of Table II below. Example 9 using 1000 ppm of Mercaptan Scavenger A reduces the headspace $H_2S$ from 542 ppm to 475 ppm. However, Example 10, which uses 500 ppm of Mercaptan Scavenger A and 500 ppm of $Co^{+3}$ (10% solution) reduces the headspace $H_2S$ from 542 ppm to 329 ppm.

TABLE II

Reduction of $H_2S$ Portion using Scavenger A and Cobalt

| Ex. | Additive | Dosage (ppm) | Headspace $H_2S$ (ppm) |
|---|---|---|---|
| 8 | Blank | 0 | 542 |
| 9 | Scavenger A | 1000 | 475 |
| 10 | Scavenger A + $Co^{+3}$ (10% soln.) | 500 + 500 | 329 |

In the foregoing specification, the methods and compositions have been described with reference to specific embodiments thereof. It has been demonstrated as effective in providing methods and compositions for reacting with and reducing the $H_2S$ and/or mercaptan proportions in hydrocarbons, particularly crude oil. However, it will be evident that various modifications and changes can be made thereto without departing from the broader spirit or scope of the methods and compositions as set forth in the appended claims. Accordingly, the specification is to be regarded in an illustrative rather than a restrictive sense. For example, specific combinations of quaternary ammonium hydroxide, quaternary ammonium alkoxide, high oxidation state metal, and other components falling within the claimed parameters, but not specifically identified or tried in a particular composition or under specific conditions, are anticipated to be within the scope of these methods and compositions.

The words "comprising" and "comprises" as used throughout the claims, is to be interpreted to mean "including but not limited to" and "includes but not limited to", respectively.

The present compositions and methods may suitably comprise, consist of or consist essentially of the elements disclosed and may be practiced in the absence of an element not disclosed. For instance, a hydrocarbon composition may consist of or consist essentially of a hydrocarbon fluid, $H_2S$ and/or mercaptans, and an aqueous scavenging composition, as recited in the claims. Similarly, methods for scavenging $H_2S$ and/or mercaptans in a hydrocarbon fluid may consist of or consist essentially of adding to a hydrocarbon fluid containing these materials an effective scavenging amount of the additives, as the additives are defined in the claims.

What is claimed is:

1. A hydrocarbon composition having a reduced $H_2S$ and/or mercaptan presence, the composition comprising:

a hydrocarbon fluid;

$H_2S$ and/or mercaptans;

an aqueous scavenging composition comprising an effective scavenging amount of an additive selected from the group consisting of a quaternary ammonium hydroxide, a quaternary ammonium alkoxide, and mixtures thereof, in the presence of a metal in an oxidation state of 3+ or greater, where the quaternary ammonium hydroxide has a formula selected from the group consisting of $R^1R^2R^3N^+OHOH^-$, $R^1R^2R^3N^+CH_2CHR^5OHOH^-$ and $R^1R^2R^3R^4N^+OH^-$, and mixtures thereof and the quaternary ammonium alkoxide has the formula $R^1R^2R^3R^4N^+O^-$, where:

$R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms, $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, $R^4$ is selected from the group consisting of hydrogen, alkyl groups of from 2 to about 18 carbon atoms, alkylaryl groups of from 7 to about 18 carbon atoms, $—(CH_2CH_2O)_nH$, where n is from 1 to about 18, $$—(CH_2CHO)_m(CH_2CH_2O)_pH,$$
$$\quad\;\; |$$
$$\quad\;\; CH_3$$

where m and p are independently selected from integers from 0 to about 18, except that the sum m+p is less than or equal to about 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, $—SR^7$ and $—NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms or alkylaryl groups of from 7 to about 18 carbon atoms where at least some of the additive has reacted with the $H_2S$ and/or mercaptan, and where there is an absence of an oxidizing agent.

2. The hydrocarbon composition of claim 1 where the hydrocarbon fluid is selected from the group consisting of crude oil, oil field condensates, residual fuels, petroleum distillates, light hydrocarbons, aromatic solvents, paraffinic solvents, dry gas streams fuels comprising oxygenated compounds, biodiesel, and mixtures thereof.

3. The hydrocarbon composition of claim 1 where the metal in an oxidation state of 3+ or greater is selected from the group consisting of Co(+3), Fe(+3), Cr(+6,+3), Ni(+3), Ce(+3,+4) and combinations thereof.

4. The hydrocarbon composition of claim 1 where the amount of additive in the hydrocarbon fluid ranges from about 20 to about 10,000 ppm.

5. The hydrocarbon composition of claim 1 where the amount of metal in the hydrocarbon fluid ranges from about 0.1 to about 5 wt % of the additive.

6. The hydrocarbon composition of claim 1 where $R^4$ is $—(CH_2CH_2O)_nH$ and n is from 1 to about 18.

7. The hydrocarbon composition of claim 1 where there is an absence of a catalyst on a basic support.

8. A hydrocarbon composition having a reduced $H_2S$ and/or mercaptan presence, the composition comprising:

a hydrocarbon fluid selected from the group consisting of crude oil, oil field condensates, residual fuels, petroleum distillates, light hydrocarbons, aromatic solvents, paraffinic solvents, dry gas streams, fuels comprising oxygenated compounds, biodiesel, and mixtures thereof;

$H_2S$ and/or mercaptans;

an aqueous scavenging composition comprising an effective scavenging amount of an additive selected from the group consisting of a quaternary ammonium hydroxide, a quaternary ammonium alkoxide, and mixtures thereof, in the presence of a metal in an oxidation state of 3+ or greater selected from the group consisting of Co(+3), Fe(+3), Cr(+6,+3), Ni(+3), Ce(+3,+4) and combinations thereof, where the quaternary ammonium hydroxide has a formula selected from the group consisting of $R^1R^2R^3N^+OHOH^-$, $R^1R^2R^3N^+CH_2CHR^5OHOH^-$ and $R^1R^2R^3R^4N^+OH^-$, and mixtures thereof and the quaternary ammonium alkoxide has the formula $R^1R^2R^3R^4N^+O^-$, where:

$R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms, $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, $R^4$ is selected from the group consisting of hydrogen, alkyl groups of from 2 to about 18 carbon atoms, alkylaryl groups of from 7 to about 18 carbon atoms, $—(CH_2CH_2O)_nH$, where n is from 1 to about 18, $$-(CH_2\underset{\underset{CH_3}{|}}{C}HO)_m(CH_2CH_2O)_pH,$$

where m and p are independently selected from integers from 0 to about 18, except that the sum m+p is less than or equal to 18, and —$CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, —$SR^7$ and —$NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms or alkylaryl groups of from 7 to about 18 carbon atoms where at least some of the additive has reacted with the $H_2S$ and/or mercaptan and where there is an absence of an oxidizing agent.

9. The hydrocarbon composition of claim 8 where the amount of additive in the hydrocarbon fluid ranges from about 20 to about 10,000 ppm.

10. The hydrocarbon composition of claim 8 where the amount of metal in the hydrocarbon fluid ranges from about 0.1 to about 5 wt % of the additive.

11. The hydrocarbon composition of claim 1 where there is an absence of a catalyst on a basic support.

* * * * *